US010869125B2

(12) United States Patent
Jin et al.

(10) Patent No.: US 10,869,125 B2
(45) Date of Patent: Dec. 15, 2020

(54) SOUND PROCESSING NODE OF AN ARRANGEMENT OF SOUND PROCESSING NODES

(71) Applicant: Huawei Technologies Co., Ltd., Shenzhen (CN)

(72) Inventors: Wenyu Jin, Shenzhen (CN); Thomas Sherson, Delft (NL); Willem Bastiaan Kleijn, Delft (NL); Richard Heusdens, Delft (NL); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/418,363

(22) Filed: May 21, 2019

(65) Prior Publication Data

US 2019/0273987 A1 Sep. 5, 2019

Related U.S. Application Data

(63) Continuation of application No. PCT/EP2016/078384, filed on Nov. 22, 2016.

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/40* (2013.01); *H04R 2420/07* (2013.01)

(58) Field of Classification Search
CPC .... H04R 3/005; H04R 1/406; H04R 2201/40; H04R 2420/07
See application file for complete search history.

(56) References Cited

U.S. PATENT DOCUMENTS 8,831,761 B2 * 9/2014 Kemp ..... G10L 19/008 370/260
9,002,027 B2 * 4/2015 Turnbull ..... G10L 21/02 381/122

(Continued)

FOREIGN PATENT DOCUMENTS

EP 1986464 A1 10/2008
WO 2007028250 A2 3/2007

OTHER PUBLICATIONS

=Frost et al., "An Algorithm for Linearly Constrained Adaptive Array Processing," Proceedings of the IEEE, vol. 60, No. 8, XP2113432A, pp. 926-935, Institute of Electrical and Electronics Engineers, New York, New York (Aug. 1972).

(Continued)

*Primary Examiner* — Jason R Kurr
(74) *Attorney, Agent, or Firm* — Leydig, Voit & Mayer, Ltd.

(57) ABSTRACT

A sound processing node is provided for an arrangement of sound processing nodes configured to receive a plurality of sound signals. The sound processing node comprises a processor configured to generate an output signal based on the plurality of sound signals weighted by a plurality of beamforming weights. The processor is configured to adaptively determine the plurality of beamforming weights on the basis of an adaptive linearly constrained minimum variance beamformer using a transformed version of a least mean squares formulation of a constrained gradient descent approach. The transformed version of the least mean squares formulation of the constrained gradient descent approach is based on a transformation of the least mean squares formulation of the constrained gradient descent approach to the dual domain.

18 Claims, 5 Drawing Sheets

(56) References Cited

U.S. PATENT DOCUMENTS

| | | | | |
|---|---|---|---|---|
| 2010/0246851 | A1* | 9/2010 | Buck | G10L 21/0208 381/94.1 |
| 2014/0126745 | A1* | 5/2014 | Dickins | H04R 3/002 381/94.3 |
| 2018/0270573 | A1 | 9/2018 | Lang et al. | |

OTHER PUBLICATIONS

Yukawa et al., "Dual-Domain Adaptive Beamformer Under Linearly and Quadratically Constrained Minimum Variance," IEEE Transactions on Signal Processing, vol. 61, No. 11, XP11509778A, pp. 2874-2886 (Jun. 1, 2013).

Capon et al., "High-Resolution Frequency-Wavenumber Spectrum Analysis," Proceedings of the IEEE, vol. 57, No. 3, pp. 1408-1418, Institute of Electrical and Electronics Engineers, New York, New York (Aug. 1969).

Er et al., "Derivative Constraints for Broad-Band Element Space Antenna Array Processors," IEEE Transactions on Acoustics, Speech, and Signal Processing, vol. ASSP-31, No. 6, pp. 1378-1393, Institute of Electrical and Electronics Engineers, New York, New York (Dec. 1983).

Heusdens et al., "Distributed MVDR beamforming for (Wireless) Microphone Networks using Message Passing," 2012 International Workshop on Acoustic Signal Enhancement, Aachen, Germany (Sep. 4-6, 2012).

O'Connor et al., "Diffusion-Based Distributed MVDR beamformer," 2014 IEEE International Conference on Acoustics, Speech and Signal Processing (ICASSP), pp. 810-814, Institute of Electrical and Electronics Engineers, New York, New York (2014).

Bertrand et al., "Distributed Node-Specific LCMV Beamforming in Wireless Sensor Networks," IEEE Transactions on Signal Processing, vol. 60, No. 1, pp. 233-246, Institute of Electrical and Electronics Engineers, New York, New York (Jan. 2012).

Sherson et al., "A Distributed Algorithm for Robust LCMV Beamforming," 2016 IEEE International Conference on Acoustics, Speech and Signal Processing (ICASSP), pp. 101-105, Institute of Electrical and Electronics Engineers, New York, New York (2016).

Zhang et al., "On Simplifying the Primal-Dual Method of Multipliers," 2016 IEEE International Conference on Acoustics, Speech and Signal Processing (ICASSP), pp. 4826-4830, Institute of Electrical and Electronics Engineers, New York, New York (2016).

Sherson et al., "A Distributed Algorithm for Robust Linearly Constrained Acoustic Beamforming," 2016 IEEE International Conference on Acoustics, Speech and Signal Processing (ICASSP), Institute of Electrical and Electronics Engineers, New York, New York (2016).

Boyd et al., "Distributed Optimization and Statistical Learning via the Alternating Direction Method of Multipliers," Foundations and Trends® in Machine Learning, vol. 3, No. 1, pp. 1-122 (2010).

Griffiths et al., "An Alternative Approach to Linearly Constrained Adaptive Beamforming," IEEE Transactions of Antennas and Propagation, vol. AP-30, No. 1, pp. 27-34, Institute of Electrical and Electronics Engineers, New York, New York (Jan. 1982).

Zeng et al., "Distributed Delay and Sum Beamformer for Speech Enhancement via Randomized Gossip," IEEE/ACM Transactions on Audio, Speech, and Language Processing, vol. 22, No. 1, pp. 260-273, Institute of Electrical and Electronics Engineers, New York, New York (Jan. 2014).

Markovich-Golan et al., "Optimal Distributed Minimum-Variance Beamforming Approaches for Speech Enhancement in Wireless Acoustic Sensor Networks," Signal Processing, vol. 107, pp. 4-20 (2015).

Zhang et al., "Bi-alternating Direction Method of Multipliers Over Graphs," 2015 IEEE International Conference on Acoustics, Speech and Signal Processing (ICASSP), pp. 3571-3575, Institute of Electrical and Electronics Engineers, New York, New York (2015).

* cited by examiner

SOUND PROCESSING NODE OF AN ARRANGEMENT OF SOUND PROCESSING NODES

CROSS-REFERENCE TO RELATED APPLICATIONS

This application is a continuation of International Application No. PCT/EP2016/078384, filed on Nov. 22, 2016, the disclosure of which is hereby incorporated by reference in its entirety.

TECHNICAL FIELD

The present invention relates to audio signal processing. In particular, the present invention relates to a sound processing node of an arrangement of sound processing nodes, a system comprising a plurality of sound processing nodes, and a method of operating a sound processing node within an arrangement of sound processing nodes.

BACKGROUND

Wireless sensor nodes have become quite powerful in terms of their computation capabilities. In particular, modern sensor-equipped devices are often capable of complex mathematical operations which allow them to be used for more complicated applications other than simple data acquisition. The notion of distributed signal processing stems from the exploitation of this computational power to solve global problems in a distributed or parallel form. In such contexts, as both data generation and processing are now distributed in the network, a different approach to the design and implementation of signal processing algorithms is required. Notably, due to the limited communication power and bandwidth available at each node, the amount of data shared between nodes is often limited.

In the field of acoustics, multi-microphone arrays have become the tool of choice for use in the processing of speech and audio signals. In particular, spatial filtering or beamforming is a ubiquitous method for improving the quality of recorded audio signals through the exploitation of spatial diversity. The minimum variance distortionless response (MVDR) beamformer, which was proposed by Capon in "High-resolution frequency-wavenumber spectrum analysis", Proceedings of the IEEE 57.8 (1969): 1408-1418, minimizes the noise power of the output signal subject to a distortionless constraint on the unknown target signal. More generally, a multiple constraint variant of the MVDR, known as the linearly constrained minimum variance (LCMV) beamformer, was introduced by Er et al. in. "Derivative constraints for broad-band element space antenna array processors." Acoustics, Speech and Signal Processing, IEEE Transactions on 31.6 (1983): 1378-1393, which provided greater control over the response of the beamformer.

Whilst beamformers have become commonplace in acoustic signal processing, in many applications where such a spatial filter can be desirable, it is difficult to guarantee the presence of a dedicated microphone array. Due to the proliferations of microphone-equipped devices being capable of wireless communication, it is possible to perform spatial audio signal processing without dedicated arrays of microphones. In particular, such devices can be used to form ad-hoc and even time varying wireless acoustic sensor networks (WASNs). The use of such networks for acoustic signal processing initially focused on the restricted case of two node networks in the context of binaural signal processing. More generally, beamforming in WASNs has focused on LCMV based algorithms and is analogous to signal processing in distributed networks. As such, the inherent restrictions of the distributed domain, most notably that of limited data access, makes the design of optimal beamforming methods challenging. To circumvent these issues, two main classes of WASN based beamformers have been proposed in the prior art: those which are approximately optimal, and those which are optimal but operate in restricted network topologies.

The most basic algorithm among the restricted topology algorithms is that of the distributed delay and sum (DS) beamformer based on randomised gossip. By replacing the true cross power spectral density (CPSD) matrix with an identity, this approach leads to a low complexity distributed solution, but fails to exploit the spatial correlation of the underlying sound field. In contrast, the approximate MVDR type beamformers presented in the work "Distributed MVDR beamforming for (wireless) microphone networks using message passing "Acoustic Signal Enhancement; Proceedings of IWAENC 2012; International Workshop on VDE, 2012 by Heusdens et al., which are based on message passing and adaption diffusion techniques, assume that nodes which do not directly share information are uncorrelated, thus masking the true CPSD. Although naturally leading to distributed implementations and exceeding the performance of the distributed delay and sum, these methods still fail to obtain the performance of centralized algorithms in all but fully connected networks.

In particular, restricted topology based algorithms allow for distributability by enforcing that the underlying networks satisfy a certain topology, typically acyclic or fully connected. As such, efficient data aggregation techniques can be adopted allowing such restrictive algorithms to cast centralized beamforming as a composition of local beamforming problems. In the context of stationary sound fields, these algorithms have been shown to iteratively converge to the optimal beamformer. However, in practical contexts the imposed restrictive topologies may be unrealistic to maintain and as such the proposed algorithms may be limited to use in specific applications.

In the prior art, there are a number of existing distributed beamformers which provide varying degrees of statistical optimality and distributed performance as summarized in the following.

In the above mentioned work by Heusdens et al., a GLiCD MVDR beamformer is presented which is based on a loopy belief propagation/message passing based approach. The GLiCD MVDR is a statistically optimal method which solves a regularized version of the MVDR problem under the assumption that the covariance matrix is known a priori. However, it only calculates the optimal beamformer weight vector and does not calculate the beamformer output without additional operation. The GLiCD algorithm also requires that the sparsity pattern of the adjacency matrix of the WSN network matches that of the covariance matrix for accurate operation. Thus, in the case of a dense covariance matrix, the GLiCD algorithm requires the network to be fully connected. For practical systems, this restriction is unrealistic as it requires the network structure to be reflective of the underlying problem. The alternative is to truncate the covariance matrix to have the sparsity pattern of the network which, however, leads to a suboptimal beamformer response, since the true covariance matrix is only approximated. These restrictions, together with the a priori assumption of a known covariance matrix, make this algorithm impractical for use in real WSN's with time varying noise fields.

In the work by O'Connor et al. "Diffusion-based distributed MVDR beamformer", Acoustics, Speech and Signal Processing (ICASSP), 2014 IEEE International Conference, 2014 a diffusion based MVDR beamformer is presented. The diffusion based MVDR is a statistically suboptimal method which solves the MVDR problem via diffusion adaptation. This diffusion adaption results in only an approximation of the covariance matrix used in the centralized MVDR beamformer, hence it has a suboptimal performance. Moreover, it requires the passing of a vector between nodes with each iteration which scales with the size of the network, whilst also storing the entire beamforming vector at each node. Thus, although this algorithm allows for network topologies that are independent of the covariance matrix structure, is has both a transmission and memory cost which scale with the size of the network. This limits the practicality of deploying the diffusion based MVDR in varying network size applications using the same hardware.

In the work by Bertrand et al., "Distributed node-specific LCMV beamforming in wireless sensor networks", Signal Processing, IEEE Transactions on 60.1 (2012): 233-246 a distributed LCMV algorithm is present, which uses a distributed topology based on combing the measurements from multiple microphones at each node in order to reduce the data transmission required within the network in the construction of different beamformer responses. In particular, DGSC uses this technique to construct a generalized sidelobe canceller (GSC) beamfomer, whilst both the distributed LCMV and LC-DANSE (which is a generalization of Distributed LCMV) solve the LCMV beamformer problem. All three above mentioned algorithms provide iterative methods of computing the beamformer response over multiple block and, in the case of static noise fields (or those which vary slowly enough), all three can converge to the optimal solution. Thus, for each block of audio, the beamformer response is suboptimal, but it may converge over time to a near-optimal response. In their most basic form, all three algorithms are based on reducing data transmission in fully connected network topologies by compressing the measurements made by local microphones and exploiting the hierarchal structure of tree or acyclic networks in order to efficiently share data. The main restriction of all three methods is due to the fact that they are only able to operate in tree shaped or fully connected networks. In the case of WSN's, which are often constructed in an ad-hoc manner, it is highly unlikely that such network topologies will satisfy either one of these properties. Thus, in ad-hoc environments, these algorithms require additional network trimming to ensure that the acyclic constraints are satisfied and this may not always be possible. Moreover, in the case of tree shaped networks, all three algorithms reduce the required amount of transmission and storage between and at nodes with varying effects. In the case of LC-DANSE and DLCMV, this leads to a reduction in the degrees of freedom at each node which can result in the algorithm not being able to converge to the optimal response without additional modification to the algorithm. Additionally, this reduction in degrees of freedom significantly slows the convergence of both algorithms.

An example of a fully cyclic, statistically optimal beamformer was proposed in "A distributed algorithm for robust LCMV beamforming", Sherson et al., Acoustics, Speech and Signal Processing (ICASSP), 2016 IEEE International Conference, 2016. In this example, the low decomposability of maximum likelihood estimated CPSD matrices in conjunction with convex duality were exploited to cast LCMV beamforming as distributed consensus. However, as the number of frames of audio used to construct the CPSD matrix increases, so does the communication cost of the algorithm which in practice increases the required transmission power of this approach. For devices with limited energy supplies, this additional communication overhead is often undesirable as it limits the lifetime of the device.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

There is a need in the art for devices and methods capable of implementing statistically more optimal adaptive beamformers for use in general network topologies with a comparatively low communications cost.

Embodiments of the invention to provide devices and methods for implementing statistically more optimal adaptive beamformers for use in general network topologies with a comparatively low communications cost.

According to a first aspect, the invention relates to a sound processing node for an arrangement of sound processing nodes, the sound processing nodes being configured to receive a plurality of sound signals, wherein the sound processing node comprises a processor configured to generate an output signal on the basis of the plurality of sound signals weighted by a plurality of beamforming weights, wherein the processor is configured to adaptively determine the plurality of beamforming weights on the basis of an adaptive linearly constrained minimum variance beamforming algorithm (also referred to as beamformer) using a transformed version of a least mean squares formulation of a constrained gradient descent approach, wherein the transformed version of the least mean squares formulation of the constrained gradient descent approach is based on a transformation of the least mean squares formulation of the constrained gradient descent approach to the dual domain.

Thus, a sound processing node is provided implementing a statistically better adaptive beamformer for use in general network topologies with a comparatively low communications cost.

In a first possible implementation form of the sound processing node according to the first aspect as such, the processor is configured to determine the plurality of beamforming weights using the transformed version of the least mean squares formulation of the constrained gradient descent approach in the dual domain on the basis of the following equations:

$$\min \sum_{i \in V} \left( \frac{1}{2} \lambda_i^H \phi_i^H \phi_i \lambda_i - \Re(\lambda_i^H (\theta_i - \phi_i^H x_i)) \right)$$

$$\text{s.t. } \lambda_i = \lambda_j \ \forall (i, j) \in E$$

wherein, i,j denote sound processing node indices, $\Re$ denotes the real part of the quantity in parenthesis, V denotes the set of all sound processing nodes of the arrangement of sound processing nodes, E denotes the set of sound processing nodes defining the edge of the arrangement of sound processing nodes, $\lambda_i$ denotes the dual variable, and $\chi_i$, $\phi_i$, and $\theta_i$ are defined by the following equations:

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

$$\theta_{i(l)} = \left[ N y_{i,l-1}^H w_{i,l-1}, N y_{i,l}^H w_{i,l-1}, N\|y_{i,l}\|_2^2, 0^T, \left(\Lambda_{i,l}^H w_{i,l-1} - \frac{f_l}{N}\right)^T \right]^T$$

wherein the index l denotes a current frame of the plurality of sound signals, the index l−1 denotes a previous frame of the plurality of sound signals, $y_{i,l}$ denotes the vector of sound signals received by i-th sound processing node in the current frame l, $w_{i,l-1}$ denotes the i-th beamforming weight vector of the previous frame l−1, N denotes the total number of sound processing nodes, $\Lambda_{i,l}$ denotes the i-th column of the matrix $\Delta_l$, and $\Delta_l$ and $f_l$ are defined by the following equations:

$$e_l = \Lambda_l(\Lambda_l^H \Lambda_l)^{-1}(\Lambda_l w_{l-1} - f_l)$$

$$a_l = \|y_l\|_2^2$$

$$b_l = (I - \Lambda_l(\Lambda_l^H \Lambda_l)^{-1}\Lambda_l^H) y_l$$

$$\hat{x}_{l|l-1} = w_{l-1}^H y_l$$

wherein $a_l$ denotes the magnitude of the vector of sound signals, $e_l$ denotes an error correction term for ensuring that the plurality of beamforming weights are unbiased, $b_l$ denotes the component of the vector of sound signals, which is orthogonal to the output signal, and $\hat{x}_{l|l-1}$ denotes the output signal for the current frame l using the plurality of beamforming weights for the previous frame l−1.

In a second possible implementation form of the sound processing node according to the first implementation form of the first aspect, the processor is configured to determine the plurality of beamforming weights using the transformed version of the least mean squares formulation of the constrained gradient descent approach in the dual domain on the basis of a basis of a distributed algorithm defined by the following equations:

$$\lambda_i^{(t+1)} = \underset{\lambda}{\operatorname{argmin}} \frac{1}{2}\lambda^H \phi_i^H \phi_i \lambda - \Re(\lambda^H(\theta_i - \phi_i^H \chi_i)) + \sum_{j \in N(i)} \left( -\frac{i-j}{|i-j|}\gamma_{j|i}^H \lambda + \frac{1}{2}\|\lambda - \lambda_j^{(t)}\|_{R_{p,i|j}}^2 \right)$$

$$\gamma_{i|j}^{(t+1)} = \gamma_{j|i}^{(t)} - \frac{i-j}{|i-j|} R_{p,i|j}(\lambda_i^{(t+1)} - \lambda_j^{(t)})$$

wherein the index t denotes a current time step, the index t−1 denotes a previous time step, N(i) denotes the set of sound processing nodes neighboring the i-th sound processing node, $\gamma_{i|j}$ denotes a dual-dual variable defined along a directed edge from the i-th sound processing node to the j-th sound processing node, and $R_{p,i|j}$ denotes a penalization matrix for penalizing the infeasibility of the edge based consensus constraints.

In a third possible implementation form of the sound processing node according to the second implementation form of the first aspect, the processor is configured to use the penalization matrix $R_{p,i|j}$ defined by the following equation:

$$R_{p,i|j} = \phi_i^H \phi_i + \phi_j^H \phi_j$$

In a fourth possible implementation form of the sound processing node according to the second or third implementation form of the first aspect, the distributed algorithm is based on an alternating direction method of multipliers (ADMM) or the primal dual method of multipliers (PDMM).

In a fifth possible implementation form of the sound processing node according to the first implementation form of the first aspect, the processor is configured to determine the plurality of beamforming weights on the basis of a message passing algorithm.

In a sixth possible implementation form of the sound processing node according to the fifth implementation form of the first aspect, the processor is configured to determine the plurality of beamforming weights on the basis of a message passing algorithm based on the following equations:

$$M_{i \to P_i} = \phi_i^H \phi_i + \sum_{k \in C_i} M_{k \to i}$$

$$m_{i \to P_i} = \phi_i^H \chi_i + \theta_i + \sum_{k \in C_i} m_{k \to i}.$$

wherein $P_i$ denotes a parent sound processing node of the i-th sound processing node;

$C_i$ denotes the set of child sound processing nodes of the i-th sound processing node;

$M_{i \to P_i}$ denotes a matrix to be transmitted from i-th sound processing node to its parent sound processing node $P_i$; and $m_{i \to P_i}$ denotes a vector to be transmitted from i-th sound processing node to its parent sound processing node $P_i$.

In a seventh possible implementation form of the sound processing node according to the first implementation form of the first aspect, the least mean squares formulation of the constrained gradient descent approach is defined by the following equation:

$$w_l = \left(I - \Lambda_l(\Lambda_l^H \Lambda_l)^{-1}\Lambda_l^H\right)\left(I - \mu \frac{y_l y_l^H}{\|y_l\|_2^2}\right) w_{l-1} + \Lambda_l(\Lambda_l^H \Lambda_l)^{-1} f_l$$

wherein μ denotes a step size parameter determining the rate of adaption of the algorithm.

According to a second aspect the invention relates to a sound processing system comprising a plurality of sound processing nodes according to the first aspect as such or any one of the different implementations thereof, wherein the plurality of sound processing nodes are configured to exchange variables for determining the plurality of beamforming weights on the basis of an adaptive linearly constrained minimum variance beamforming algorithm (i.e. beamformer) using a transformed version of a least mean squares formulation of a constrained gradient descent approach, wherein the transformed version of the least mean squares formulation of the constrained gradient descent approach is based on a transformation of the least mean squares formulation of the constrained gradient descent approach to the dual domain.

According to a third aspect, the invention relates to a method of operating a sound processing node for an arrangement of sound processing nodes, the sound processing nodes being configured to receive a plurality of sound signals, wherein the method comprises the step of generating an output signal on the basis of the plurality of sound signals weighted by a plurality of beamforming weights by adaptively determining the plurality of beamforming weights on the basis of an adaptive linearly constrained minimum variance beamforming algorithm using a transformed version of a least mean squares formulation of a constrained gradient descent approach, wherein the transformed version of the least mean squares formulation of the constrained gradient descent approach is based on a transformation of the least mean squares formulation of the constrained gradient descent approach to the dual domain.

In a first possible implementation form of the method according to the third aspect as such, the step of determining the plurality of beamforming weights using the transformed version of the least mean squares formulation of the constrained gradient descent approach in the dual domain is based on the following equations:

$$\min \sum_{i \in V} \left( \frac{1}{2} \lambda_i^H \phi_i^H \phi_i \lambda_i - \Re\left(\lambda_i^H (\theta_i - \phi_i^H \chi_i)\right) \right)$$

$$\text{s.t. } \lambda_i = \lambda_j \ \forall (i, j,) \in E$$

wherein i,j denote sound processing node indices, $\Re(\ldots)$ denotes the real part of the quantity in parenthesis, V denotes the set of all sound processing nodes of the arrangement of sound processing nodes, E denotes the set of sound processing nodes defining the edge of the arrangement of sound processing nodes, $\lambda_i$ denotes the dual variable, and $\chi_i$, $\phi_i$, and $\theta_i$ are defined by the following equations:

$$\psi_i = [x_{i,l-1}^{*T}, \hat{x}_{i,l|l-1}^{*T}, a_i^T, b_i^T, e_i^T]^T$$

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

$$\theta_{i(l)} = \left[ N y_{i,l-1}^H w_{i,l-1}, N y_{i,l}^H w_{i,l-1}, N \|y_{i,l}\|_2^2, 0^T, \left( \Lambda_{i,l}^H w_{i,l-1} - \frac{f_l}{N} \right)^T \right]^T$$

wherein the index l denotes a current frame of the plurality of sound signals, the index l−1 denotes a previous frame of the plurality of sound signals, $y_{i,l}$ denotes the vector of sound signals received by i-th sound processing node in the current frame l, $w_{i,l-1}$ denotes the i-th beamforming weight vector of the previous frame l−1, N denotes the total number of sound processing nodes, $\Lambda_{i,l}$ denotes the i-th column of a matrix $\Lambda_l$, and $\Lambda_l$ and $f_l$ are defined by the following equations:

$$e_l = \Lambda_l (\Lambda_l^H \Lambda_l)^{-1} (\Lambda_l w_{l-1} - f_l)$$

$$a_l = \|y_l\|_2^2$$

$$b_l = (I - \Lambda_l (\Lambda_l^H \Lambda_l)^{-1} \Lambda_l^H) y_l$$

$$\hat{x}_{l|l-1} = w_{l-1}^H y_l$$

wherein $\alpha_l$ denotes the magnitude of the vector of sound signals, $e_l$ denotes an error correction term for ensuring that the plurality of beamforming weights are unbiased, $b_l$ denotes the component of the vector of sound signals, which is orthogonal to the output signal, and $\hat{x}_{l|l-1}$ denotes the output signal for the current frame l using the plurality of beamforming weights for the previous frame l−1.

In a second possible implementation form of the method according to the first implementation form of the third aspect, the step of determining the plurality of beamforming weights using the transformed version of the least mean squares formulation of the constrained gradient descent approach in the dual domain is based on a distributed algorithm defined by the following equations:

$$\lambda_i^{(t+1)} = \underset{\lambda}{\operatorname{argmin}} \ \frac{1}{2} \lambda^H \phi_i^H \phi_i \lambda - \Re\left(\lambda^H (\theta_i - \phi_i^H \chi_i)\right) + \sum_{j \in N(i)} \left( -\frac{i-j}{|i-j|} \gamma_{j|i}^H \lambda + \frac{1}{2} \|\lambda - \lambda_j^{(t)}\|_{R_{p,i|j}}^2 \right)$$

$$\gamma_{i|j}^{(t+1)} = \gamma_{j|i}^{(t)} - \frac{i-j}{|i-j|} R_{p,i|j} (\lambda_i^{(t+1)} - \lambda_j^{(t)})$$

wherein the index t denotes a current time step, the index t−1 denotes a previous time step, N(i) denotes the set of sound processing nodes neighboring the i-th sound processing node, $\gamma_{i|j}$ denotes a dual-dual variable defined along a directed edge from the i-th sound processing node to the j-th sound processing node, and $R_{p,i|j}$ denotes a penalization matrix for penalizing the infeasibility of the edge based consensus constraints.

In a third possible implementation form of the method according to the second implementation form of the third aspect, the penalization matrix $R_{p,i|j}$ is defined by the following equation:

$$R_{p,i|j} = \phi_i^H \phi_i + \phi_j^H \phi_j$$

In a fourth possible implementation form of the method according to the second or third implementation form of the third aspect, the distributed algorithm is based on an alternating direction method of multipliers (ADMM) or the primal dual method of multipliers (PDMM).

In a fifth possible implementation form of the method according to the first implementation form of the third aspect, the step of determining the plurality of beamforming weights is based on a message passing algorithm.

In a sixth possible implementation form of the method according to the fifth implementation form of the third aspect, the step of determining the plurality of beamforming weights on the basis of a message passing algorithm is based on the following equations:

$$M_{i \to \mathcal{P}_i} = \phi_i^H \phi_i + \sum_{k \in C_i} M_{k \to i}$$

$$m_{i \to \mathcal{P}_i} = \phi_i^H \chi_i + \theta_i + \sum_{k \in C_i} m_{k \to i}.$$

wherein $P_i$ denotes a parent sound processing node of the i-th sound processing node, $C_i$ denotes the set of child sound processing nodes of the i-th sound processing node, $M_{i \to P_i}$ denotes a matrix to be transmitted from i-th sound processing node to its parent sound processing node $P_i$, and $m_{i \to P_i}$ denotes a vector to be transmitted from i-th sound processing node to its parent sound processing node $P_i$.

In an seventh possible implementation form of the method according to the first implementation form of the third aspect, the least mean squares formulation of the constrained gradient descent approach is defined by the following equation:

$$w_l = (I - \Lambda_l(\Lambda_l^H \Lambda_l)^{-1} \Lambda_l^H)\left(I - \mu \frac{y_l y_l^H}{\|y_l\|_2^2}\right) w_{l-1} + \Lambda_l(\Lambda_l^H \Lambda_l)^{-1} f_l$$

wherein μ denotes a step size parameter determining the rate of adaption of the algorithm.

According to a fourth aspect the invention relates to a computer program product comprising program code for performing the method according to the third aspect as such or its different implementation forms, when executed on a computer.

The invention can be implemented in hardware and/or software.

BRIEF DESCRIPTION OF THE DRAWINGS

Further embodiments of the invention will be described with respect to the following figures, in which.

In the various figures, identical reference signs will be used for identical or at least functionally equivalent features.

DETAILED DESCRIPTION OF THE EMBODIMENTS

In the following detailed description, reference is made to the accompanying drawings, which form a part of the disclosure, and in which are shown, by way of illustration, specific aspects in which the present invention may be practiced. It is understood that other aspects may be utilized and structural or logical changes may be made without departing from the scope of the present invention. The following detailed description, therefore, is not to be taken in a limiting sense, as the scope of the present invention is defined by the appended claims.

For instance, it is understood that a disclosure in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless specifically noted otherwise.

Figure 1:
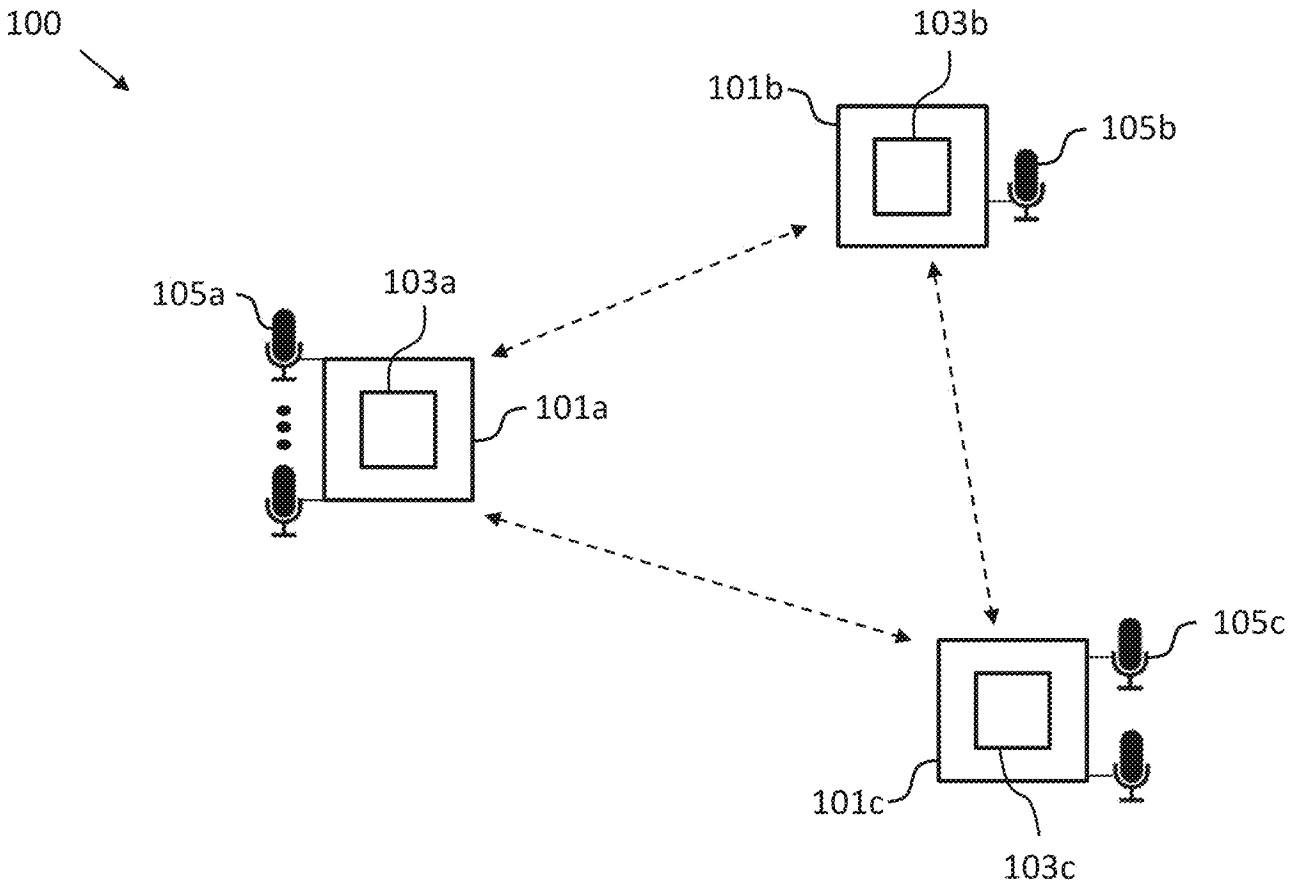
FIG. 1 shows a schematic diagram illustrating an arrangement of sound processing nodes according to an embodiment.

FIG. 1 shows an arrangement or system 100 of sound processing nodes 101*a-c* according to an embodiment including a sound processing node 101*a* according to an embodiment. The sound processing nodes 101*a-c* are configured to receive a plurality of sound signals form one or more target sources, for instance, speech signals from one or more speakers located at different positions with respect to the arrangement 100 of sound processing nodes. To this end, each sound processing node 101*a-c* of the arrangement 100 of sound processing nodes 101*a-c* can comprise one or more microphones 105*a-c*. In the exemplary embodiment shown in FIG. 1, the sound processing node 101*a* comprises more than two microphones 105*a*, the sound processing node 101*b* comprises one microphone 105*b* and the sound processing node 101*c* comprises two microphones.

In the exemplary embodiment shown in FIG. 1, the arrangement 100 of sound processing nodes 101*a-c* consists of three sound processing nodes, namely the sound processing nodes 101*a-c*. However, it will be appreciated, for instance, from the following detailed description that the present invention also can be implemented in form of an arrangement or system 100 of sound processing nodes having a smaller or a larger number of sound processing nodes. Save to the different number of microphones the sound processing nodes 101*a-c* can be essentially identical, i.e. all of the sound processing nodes 101*a-c* can comprise a processor 103*a-c* being configured essentially in the same way.

The processor 103*a* of the sound processing node 101*a* is configured to generate an output signal on the basis of the plurality of sound signals weighted by a plurality of beamforming weights by adaptively determining the plurality of beamforming weights on the basis of an adaptively linearly constrained minimum variance beamformer (i.e. beamforming algorithm) using a transformed version of a least mean squares formulation of a constrained gradient descent approach, wherein the transformed version of the least mean squares formulation of the constrained gradient descent approach is based on a transformation of the least mean squares formulation of the constrained gradient descent approach to the dual domain.

Figure 2:
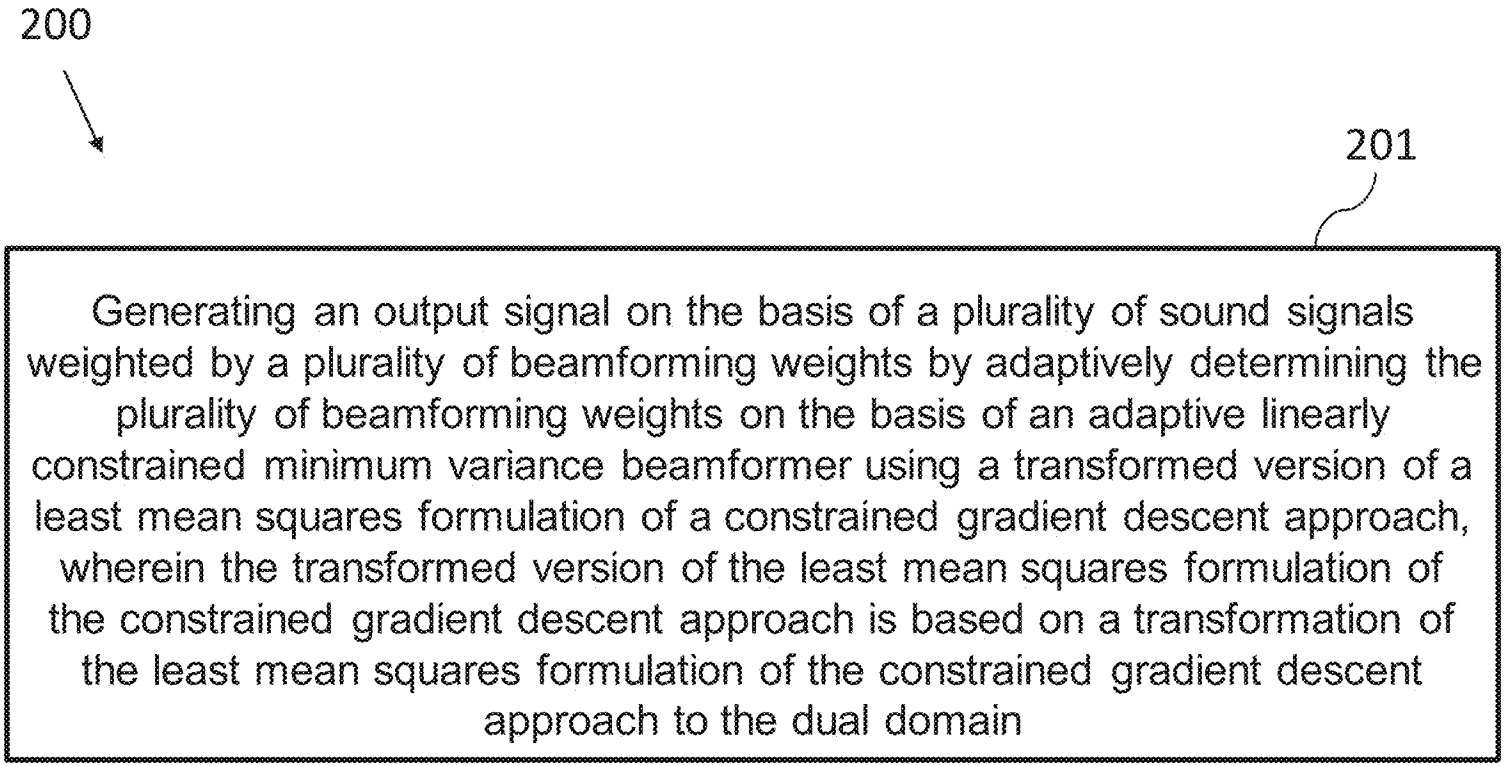
FIG. 2 shows a schematic diagram illustrating a method of operating a sound processing node according to an embodiment.

FIG. 2 shows a schematic diagram illustrating a method 200 of operating the sound processing node 101*a* according to an embodiment. The method 200 comprises a step of generating 201 an output signal on the basis of the plurality of sound signals weighted by a plurality of beamforming weights by adaptively determining the plurality of beamforming weights on the basis of an adaptive linearly constrained minimum variance beamformer (i.e. beamforming algorithm) using a transformed version of a least mean squares formulation of a constrained gradient descent approach, wherein the transformed version of the least mean squares formulation of the constrained gradient descent approach is based on a transformation of the least mean squares formulation of the constrained gradient descent approach to the dual domain.

Before describing some further embodiments of the sound processing node 101*a* and the method 200 some mathematical background will be introduced in the following.

In embodiments of the invention, algorithms making use of spatial diversity of beamforming or spatial filtering can be used, which generally focus on the simultaneous preservation of an unknown target signal and the reduction of the variance of the estimated signal. A large number of beamforming algorithms exist including both data driven and data independent implementations, such as the minimum variance distortionless response (MVDR) beamformer (e.g., see "High-resolution frequency-wavenumber spectrum analysis", Capon, J., Proceedings of the IEEE 57.8 (1969): 1408-1418). This data driven algorithm ensures the preservation of the target source through a linear constraint function and minimizes the output variance by minimizing the noise power of the sound field. As such, the optimal weight vector $\overline{w}$ can be found as the solution of the following quadratic optimization problem:

$$\min \tfrac{1}{2} w^H P_{y,l} w$$

$$s.t.\ a^H w = 1$$

wherein w is a weight vector, $P_{y,l}$ denotes the noise cross power spectral density matrix of the observations and a denotes the acoustic transfer function of the target signal. Using Lagrange multipliers, the optimal weight vector $\overline{w}$ can be shown to be given by the following equation:

$$\overline{w} = P_{y,l}^{-1} a (a^H P_{y,l}^{-1} a)$$

As a generalization of the MVDR, the linearly constrained minimum variance (LCMV) beamformer was introduced by Er and Catoni (see "Derivative constraints for broad-band element space antenna array processors", Acoustics, Speech and Signal Processing, IEEE Transactions on 31.6 (1983): 1378-1393) and provides increased control over the beam pattern of the spatial filter via the use of additional linear constraints. The computation of the optimal LCMV weight vector can be performed by solving the modified optimization problem given by:

$$\min \tfrac{1}{2} w^H P_{y,l} w$$

$$s.t.\ \Lambda^H w = f$$

wherein Λ denotes a matrix whose columns denote the set of linear constraints of the LCMV beamformer.

In embodiments of the invention, the additional constraints, which include as a subset the distortionless response constraint, can be used for a wide variety of purposes including the nulling of some known interferes. Given any particular algorithm, a challenge of statistically optimal beamforming, in the distributed sense, can be the need to generate an estimated covariance matrix as well as the actual beamformer output without having access to global information. In particular, the time varying nature of real world noise fields means that only a small number of frames can often be used in constructing the covariance matrix rather than a large number of noise-only frames. This also means that the estimated covariance matrix needs to be readily updated to adapt to these changes in the noise field, which means that it and the actual beamformer weight vector cannot simply be computed "offline" or in advanced. One way to address the time varying nature of the CPSD matrix is via the use of adaptive beamforming algorithms. Frost and Lamont suggested in their work "An algorithm for linearly constrained adaptive array processing "Proceedings of the IEEE 60.8 (1972): 926-935, an adaptive beamformer which is an adaptive variant of the MVDR beamformer. Based on a constrained LMS algorithm, this method aims to iteratively optimize the weight vector of the classic MVDR algorithm via constrained gradient descent, wherein, in each frame, the true covariance matrix is replaced with a rank one estimate. The closed form solution of a normalize gradient descent variation of this algorithm is given by:

$$w_l = \left(I - \Lambda_l(\Lambda_l^H \Lambda_l)^{-1} \Lambda_l^H\right)\left(I - \mu \frac{y_l y_l^H}{\|y_l\|_2^2}\right) w_{l-1} + \Lambda_l(\Lambda_l^H \Lambda_l)^{-1} f_l \tag{1}$$

Whilst in a centralized context, these updates are relatively simple to compute, in a distributed context, they can be more challenging. Especially, for the more general and in many ways more realistic context of cyclic network topologies, no such solution currently exists.

Embodiments of the invention can be based on the fact that the classic constrained LMS adaptive beamformer proposed in the above mentioned work by Frost can be expressed as the product of a number of distinct components. In particular, equation 1 can be rewritten as:

$$w_l = w_{l-1} - e_l - \frac{\mu}{a_l} b_l \hat{x}_{l|l-1}^*$$

wherein $$e_l = \Lambda_l(\Lambda_l^H \Lambda_l)^{-1}(\Lambda_l w_{l-1} - f_l)$$

$$a_l = \|y_l\|_2^2$$

$$b_l = (I - \Lambda_l(\Lambda_l^H \Lambda_l)^{-1} \Lambda_l^H) y_l$$

$$\hat{x}_{l|l-1} = w_{l-1}^H y_l$$

wherein μ denotes a step size parameter determining the rate of adaption of the algorithm, $a_l$ denotes the magnitude of the vector of sound signals or measurement vector $y_l$, $e_l$ denotes an error correction term for ensuring that the plurality of beamforming weights are unbiased, $b_l$ denotes the component of the vector of sound signals $y_l$, which is orthogonal to the output signal (i.e., the noise and interference signals), and $\hat{x}_{l|l-1}$ denotes the output signal for the current frame l using the plurality of beamforming weights for the previous frame l−1. Furthermore, once these components have been computed and are known at each node, the local weight vector component and beamformer output can simply be constructed via data aggregation. According to this decomposition each component can be computed as the solution of either a data aggregation or constrained least squares problem, both of which can be distributed. The resulting optimization problems, which can be used in embodiments of the invention, are given by the following equations:

$$x_{l-1}^* = \arg\min \tfrac{1}{2}\|x_{l-1}^*\|_2^2\ s.t.\ N y_{l-1}^H w_{l-1} = 1^T x_{l-1}^*$$

$$\hat{x}_{l|l-1}^* = \arg\min \tfrac{1}{2}\|\hat{x}_{l|l-1}^*\|_2^2\ s.t.\ N y_l^H w_{l-1} = 1^T \hat{x}_{l|l-1}$$

$$a_l = \arg\min \tfrac{1}{2}\|a\|_2^2\ s.t.\ N y_l^H y_l = 1^T a$$

$$b_l = \arg\min \tfrac{1}{2}\|b_l - y_l\|_2^2\ s.t.\ \Lambda_l^H b_l = 0$$

$$e_l = \arg\min \tfrac{1}{2}\|e_l\|_2^2\ s.t.\ \Lambda_l^H e_l = \Lambda_l^H w_{l-1} - f_l \tag{2}$$

wherein N denotes the total number of sound processing nodes and $f_l$ is defined so that the last equation in the group of equations 2 is satisfied.

In embodiments of the invention, the implementation of the distributed constrained LMS (DCL) beamformer is based on the notion of dual decomposition. For this purpose, equation 2 can be solved via a single optimization form given by:

$$\min \tfrac{1}{2}(\|x_{l-1}^*\|_2^2+\|\hat{x}_{l|l-1}^*\|_2^2+\|a\|_2^2+\|b_l-y_l\|_2^2+\|e_l\|_2^2)$$

$$s.t.\ Ny_{l-1}^H w_{l-1}=1^T x_{l-1}^*$$

$$Ny_l^H w_{l-1}=1^T \hat{x}_{l|l-1}^*$$

$$Ny_l^H y_l=1^T a$$

$$\Lambda_l^H b_l=0$$

$$\Lambda_l^H e_l=\Lambda_l^H w_{l-1}-f_l$$

For the sake of simplicity, in embodiments of the invention, an additional set of variables can be introduced as follows:

$$\psi_i = [x_{i,l-1}^{*T}, \hat{x}_{i,l|l-1}^{*T}, a_i^T, b_i^T, e_i^T]^T$$

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

$$\theta_{i(l)} = \left[Ny_{i,l-1}^H w_{i,l-1}, Ny_{i,l}^H w_{i,l-1}, N\|y_{i,l}\|_2^2, 0^T, \left(\Lambda_{i,l}^H w_{i,l-1} - \frac{f_l}{N}\right)^T\right]^T$$

wherein the index l denotes a current frame of the plurality of sound signals, the index l–1 denotes a previous frame of the plurality of sound signals, $y_{i,l}$ denotes the vector of sound signals received by i-th sound processing node in the current frame l, $w_{i,l-1}$ denotes the i-th beamforming weight vector of the previous frame l–1, and $\Lambda_{i,l}$ and $f_l$ are defined by equations 2.

In such a way, according to an embodiment, the optimization problem can also be rewritten as:

$$\min \sum_{i\in V} \frac{1}{2}\|\psi_i - \chi_i\|_2^2$$

wherein V denotes the set $$\text{s.t.} \sum_{i\in V} (\phi_i^H \psi_i - \theta_i) = 0 \quad \forall\, i \in V$$

of all sound processing nodes 101*a-c* of the arrangement 100 of sound processing nodes 101*a-c*.

Furthermore, in order to solve this constrained optimization problem, the equivalent problem of finding a saddle point of the associated Lagrangian with real values can be considered in embodiments of the invention, wherein the real valued Lagrangian is given by the following equation:

$$\mathcal{L}(\psi, \lambda) = \sum_{i\in V}\left(\frac{1}{2}\|\psi_i - \chi_i\|_2^2 - \Re(\lambda^H(\phi_i^H \psi_i - \theta_i))\right)$$

The saddle points of the Lagrangian can be computed as the zeros of its partial derivatives with respect to the primal variables such that:

$$\psi_i=\chi_i+\phi_i\lambda \ \forall i\in V$$

Importantly, due to the separable nature of both the objective function and linear constraints, the computation of this saddle point is equivalent to solving for the global dual variable vector λ. In order to compute this dual variable vector, the dual problem of the Lagrangian can be formulated, so that:

$$\min \sum_{i\in V}\left(\frac{1}{2}\lambda^H \phi_i^H \phi_i \lambda - \Re(\lambda^H(\theta_i - \phi_i^H \chi_i))\right) \tag{3}$$

wherein ℜ denotes the real part of the quantity in parenthesis. Afterwards, in order to form the final distributed implementation, local variables $\lambda_i$ representing the dual variables at each node i can be introduced. Then, additional consensus constraints can be imposed along each edge of our WASN to ensure that at optimality these are all the same. The resulting dual distributed optimization form is given by:

$$\min \sum_{i\in V}\left(\frac{1}{2}\lambda_i^H \phi_i^H \phi_i \lambda_i - \Re(\lambda_i^H(\theta_i - \phi_i^H \chi_i))\right) \tag{4}$$

$$\text{s.t.}\ \lambda_i = \lambda_j \ \forall\, (i, j) \in E$$

wherein E denotes the set of sound processing nodes 101*a-c* defining the edge of the arrangement 100 of sound processing nodes 101*a-c*.

The general nature of the final distributed optimization problem (e.g., see "A distributed algorithm for robust LCMV beamforming" Acoustics, Speech and Signal Processing (ICASSP), Sherson et al. 2016 IEEE International Conference, 2016) implies that it can be solved via a number of existing solutions in both cyclic and acyclic networks, as will be described in the following.

In cyclic networks, equation 4 is already in such a form that it can be solved by existing state of the art distributed solvers including the likes of the alternating direction method of multipliers (ADMM) ("Distributed optimization and statistical learning via the alternating direction method of multipliers.", Boyd et al., Foundations and Trends in Machine Learning 3.1 (2011): 1-122) and the primal dual method of multipliers (PDMM) ("On simplifying the primal-dual method of multipliers." Zhang et al., Acoustics, Speech and Signal Processing (ICASSP), 2016 IEEE International Conference, 2016). The major benefit of using such algorithms to compute the optimal weight vector derives from the fact that in practice many networks contain cyclic loops unless additional care is taken to restrict and control the topology of the network. In particular, in the case of node failure, acyclic graphs can become partitioned into multiple sub graphs whereas the redundancy of cyclic networks increases the probability of the network maintaining a single connected structure.

In an embodiment, the computation of the optimal dual vector $\lambda_i$ at each sound processing node 101*a-c* via the use of PDMM is considered. Based on the general PDMM updating scheme, it can be shown that in an embodiment equation 4 can be iteratively solved via PDMM using the following node based update equations.

$$\lambda_i^{(t+1)} = \underset{\lambda}{\operatorname{argmin}} \frac{1}{2}\lambda^H \phi_i^H \phi_i \lambda - \Re(\lambda^H(\theta_i - \phi_i^H \chi_i)) + \sum_{j \in N(i)} \left(-\frac{i-j}{|i-j|}\gamma_{j|i}^H \lambda + \frac{1}{2}\|\lambda - \lambda_j^{(t)}\|_{R_{p,i|j}}^2\right) \quad (5)$$

wherein $\gamma_{i|j}$ are $$\gamma_{i|j}^{(t+1)} = \gamma_{j|i}^{(t)} - \frac{i-j}{|i-j|} R_{p,i|j}(\lambda_i^{(t+1)} - \lambda_j^{(t)})$$

the dual-dual variables introduced along each directed edge i→j. Additionally, penalizing matrices $R_{p,i|j}$ can be used to penalize the infeasibility of the edge based consensus constraints. Whilst in general there are no specific rules for the selection of these penalty terms, in an embodiment the following particular choice of:

$$R_{p,i|j} = \phi_i^H \phi_i + \phi_j^H \phi_j$$

can provide a significant increase in convergence rate. Equivalently, ADMM can also be used as a solver for the same optimization problem resulting in a similar iterative algorithm (see also FIG. 3).

Alternative embodiments can be used, if a greater restriction on the network topology is preferred in order to remove the presence of all cyclic paths. By considering the separable nature of equation 3, it can be noted that the optimal dual variable vector can be directly computed from the summation of the matrices $\phi_i^H \phi_i$ and the vectors $\theta_i - \phi_i^H \chi_i$. In acyclic networks, this can be achieved by means of efficient data aggregation techniques. This message passing can begin at leaf nodes, in particular at those nodes with only a single neighbor, having parent node $\wp_i$. In an embodiment, each leaf node can transmit the matrix and vector messages:

$$M_{i \to \wp_i} = \phi_i^H \phi_i + \sum_{k \in C_i} M_{k \to i} \quad (6)$$

$$m_{i \to \wp_i} = \phi_i^H \mathcal{X}_i + \theta_i + \sum_{k \in C_i} m_{k \to i}.$$

respectively to this parent node $\wp_i$, wherein C(i) denotes the set of child nodes of a sound processing node or node i, in particular those nodes j for which $i = \wp_i$. Subsequently, all sound processing nodes 101*a-c* which have received messages from all their neighbors bar one can perform the same message passing procedure, a process which can be repeated until the root node is found. Then, this node can directly solve equation 3 after which the optimal λ can be diffused back into the network (see also FIG. 4).

Embodiments of the invention provide the advantage of performing classic centralized adaptive beamforming in a distributed context. Moreover, embodiments of the invention incorporate, simultaneously, the computation of the beamformer weight vector and beamformer output. Furthermore, by exploiting a normalized gradient descent approach, embodiments of the invention remove the need for directly estimating the true CPSD matrix reducing transmission costs between sound processing nodes.

Moreover, embodiments of the invention provide the advantage of representing a novel method for performing adaptive LCMV beamforming in a distributed wireless acoustic sensor network (WASN). In particular, an advantage of the adaptive approach stems from removing the need for directly estimating and inverting the true cross power spectral density (CPSD) matrix used in centralized statistically optimal beamformers. A further advantage of this algorithm lies in the means of distributing the centralized algorithm by casting constrained LMS beamforming as a set of dual distributable consensus problems. This allows embodiments of the invention to operate in general network topologies and to significantly reduce per-frame transmission costs in both cyclic and acyclic networks making it an ideal choice for use in large scale WASNs with restricted power supplies. Moreover, as the DCL can be equivalent to classic constrained LMS beamforming, in stationary sound fields it can iteratively obtain statistical optimality. In non-stationary sound fields, embodiments of the invention can also track variations in the sound field making it practical for use in a lot of applications.

Figure 3:
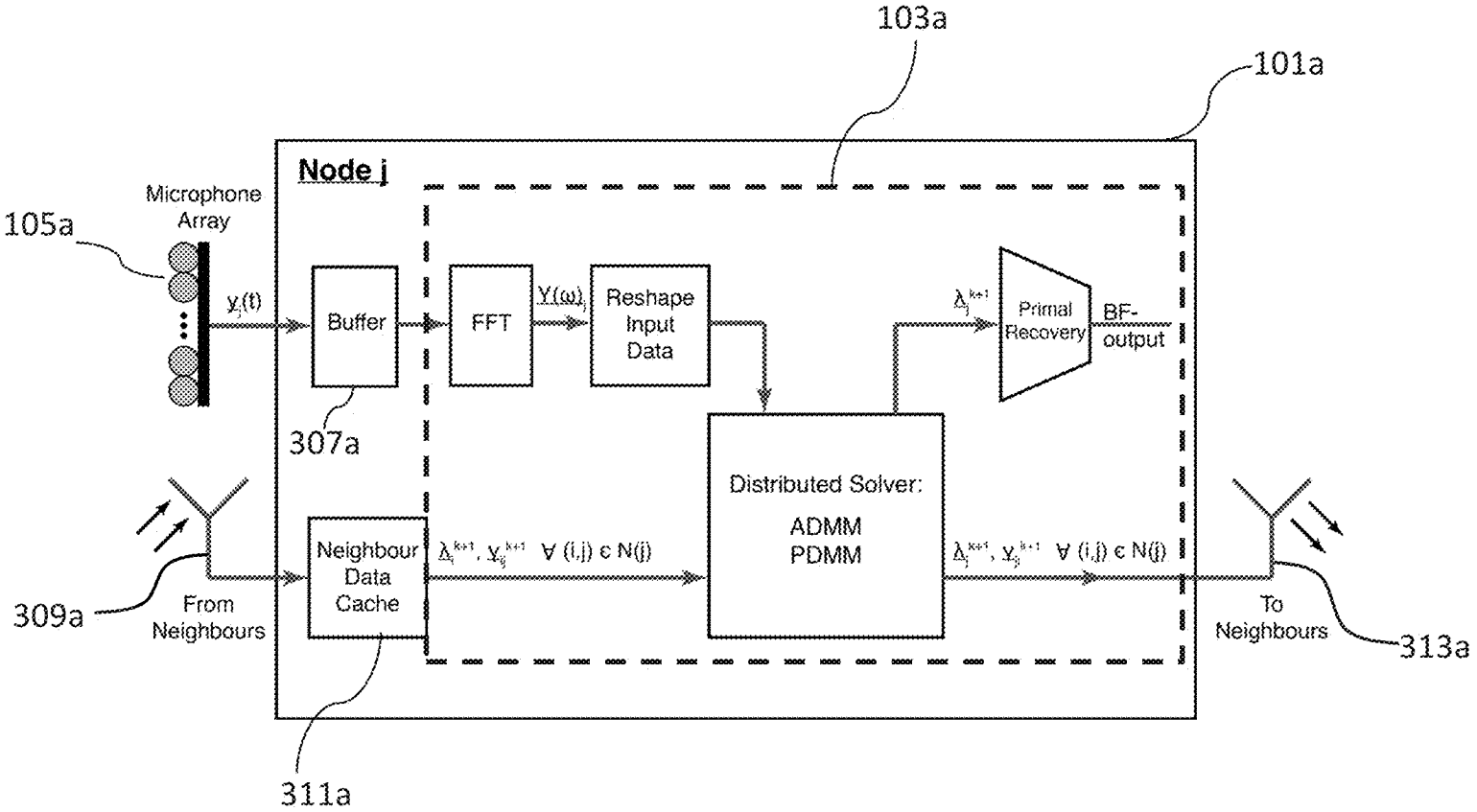
FIG. 3 shows a schematic diagram of a sound processing node according to an embodiment.

FIG. 3 shows a schematic diagram of an embodiment of the sound processing node 101*a* with the processor 103*a* being configured to determine the plurality of beamforming weights on the basis of iteratively solving equations 5, i.e. using, for instance, the alternating direction method of multipliers (ADMM) or the primal dual method of multipliers (PDMM).

In the embodiment shown in FIG. 3, the sound processing node 101*a* can comprise in addition to the processor 103*a* and the plurality of microphones 105*a*, a buffer 307*a* configured to store at least portions of the sound signals received by the plurality of microphones 105*a*, a receiver 309*a* configured to receive variables from neighboring sound processing nodes for determining the plurality of beamforming weights, a cache 311*a* configured to store at least temporarily the variables received from the neighboring sound processing nodes and a emitter 313*a* configured to send variables to neighboring sound processing nodes for determining the plurality of beamforming weights.

In the embodiment shown in FIG. 3, the receiver 309*a* of the sound processing node 101*a* is configured to receive the variables $\lambda_i^{k+1}$ and $\gamma_{i|j}^{k+1}$ as defined by equation 5 from the neighboring sound processing nodes and the emitter 313*a* is configured to send the variables as defined by equation 5 to the neighboring sound processing nodes. In an embodiment, the receiver 309*a* and the emitter 313*a* can be implemented in the form of a single communication interface.

Moreover, the processor 103*a* can be configured to determine the plurality of beamforming weights in the frequency domain. Thus, in an embodiment the processor 103*a* can be further configured to transform the plurality of sound signals received by the plurality of microphones 105*a* into the frequency domain using a Fourier transform.

In the embodiment shown in FIG. 3, the processor 103*a* of the sound processing node 101*a* is configured to compute for each iteration and each sound processing node or node i (N(i)+1)(3+2r) variables, where N(i) is the number of neighboring nodes of node i and r is the number of linear constraints. Due to the quadratic nature of equation 5, these values can be computed analytically, hence this computation can be very efficient. Additionally, these updated variables can be transmitted to the appropriate neighboring nodes, a process which can be achieved either via a wireless broadcast or directed transmission scheme. Different communication protocols can be used, however PDMM is inherently immune to packet loss, so there is no need for handshaking routines, if the increased convergence time associated with the loss of packets can be tolerated. This iterative algorithm can then be run until convergence is achieved with a satisfactory error, at which point the next block of audio can be processed.

Figure 4:
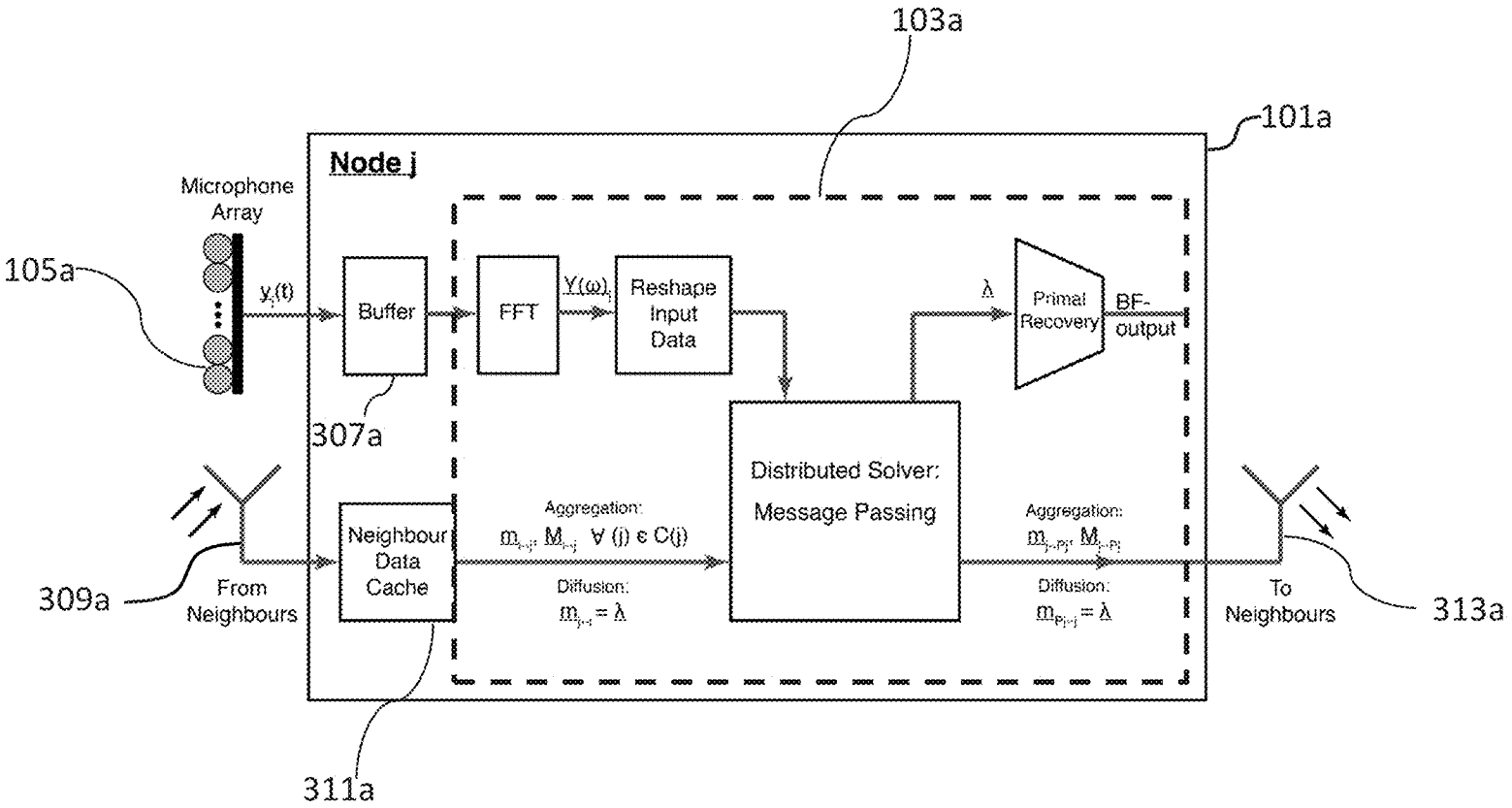
FIG. 4 shows a schematic diagram of a sound processing node according to an embodiment.

FIG. 4 shows a schematic diagram of an embodiment of the sound processing node 101*a* with the processor 103*a* being configured to determine the plurality of beamforming weights on the basis of equation 6, namely on the basis of a message passing algorithm.

In the embodiment shown in FIG. 4, the sound processing node 101*a* can comprise in addition to the processor 103*a* and the plurality of microphones 105*a*, a buffer 307*a* configured to store at least portions of the sound signals received by the plurality of microphones 105*a*, a receiver 309*a* configured to receive variables from neighboring sound processing nodes for determining the plurality of beamforming weights, a cache 311*a* configured to store at least temporarily the variables received from the neighboring sound processing nodes and a emitter 313*a* configured to send variables to neighboring sound processing nodes for determining the plurality of beamforming weights.

In the embodiment shown in FIG. 4, the receiver 309*a* of the sound processing node 101*a* is configured to receive the messages as defined by equation 6 from the neighboring sound processing nodes and the emitter 313*a* is configured to send the message defined by equation 18 to the neighboring sound processing nodes. In an embodiment, the receiver 309*a* and the emitter 313*a* can be implemented in the form of a single communication interface.

As already described above, the processor 103*a* can be configured to determine the plurality of beamforming weights in the frequency domain. Thus, in an embodiment, the processor 103*a* can be further configured to transform the plurality of sound signals received by the plurality of microphones 105*a* into the frequency domain using a Fourier transform.

For acyclic networks, this implementation yields a significantly faster convergence rate in contrast to the iterative PDMM and ADMM variants. However, it requires a lot of care in the implementation and management of the WASN architecture. In particular, if the chance of packet loss is neglected, the total transmission cost per frame of audio for the acyclic algorithm can be exactly computed. In particular, by exploiting the scarcity of the aggregated messages, $2(3+2r)(2N-K-1)$ variables need to be transmitted, wherein N represent the number of sound processing nodes in the network and K is the number of leaf nodes.

Embodiments of the invention can be implemented in the form of automated speech dictation systems, which are a useful tool in business environments for capturing the contents of a meeting. A common issue, though, is that as the number of users increases, so does the noise within audio recordings, due to the movement and additional talking that can take place within the meeting. This issue can be addressed in part through beamforming. However, since dedicated spaces equipped with centralized systems should be used or personal microphones should be attached to everyone in order to improve the SNR of each speaker, this can be an invasive and irritating procedure. In contrast, by utilizing existing microphones present at any meeting, namely those attached to the cellphones of those present, embodiments of the invention can be used to form ad-hoc beamforming networks to achieve the same goal. Additionally, the benefit of this type of approach is that it achieves a naturally scaling architecture, since the number of nodes (cellphones) increases when more members are present in the meeting. When combined with the network size, embodiments of this invention would lead to a very flexible solution for providing automated speech beamforming as a front end for automated speech dictation systems.

Figure 5:
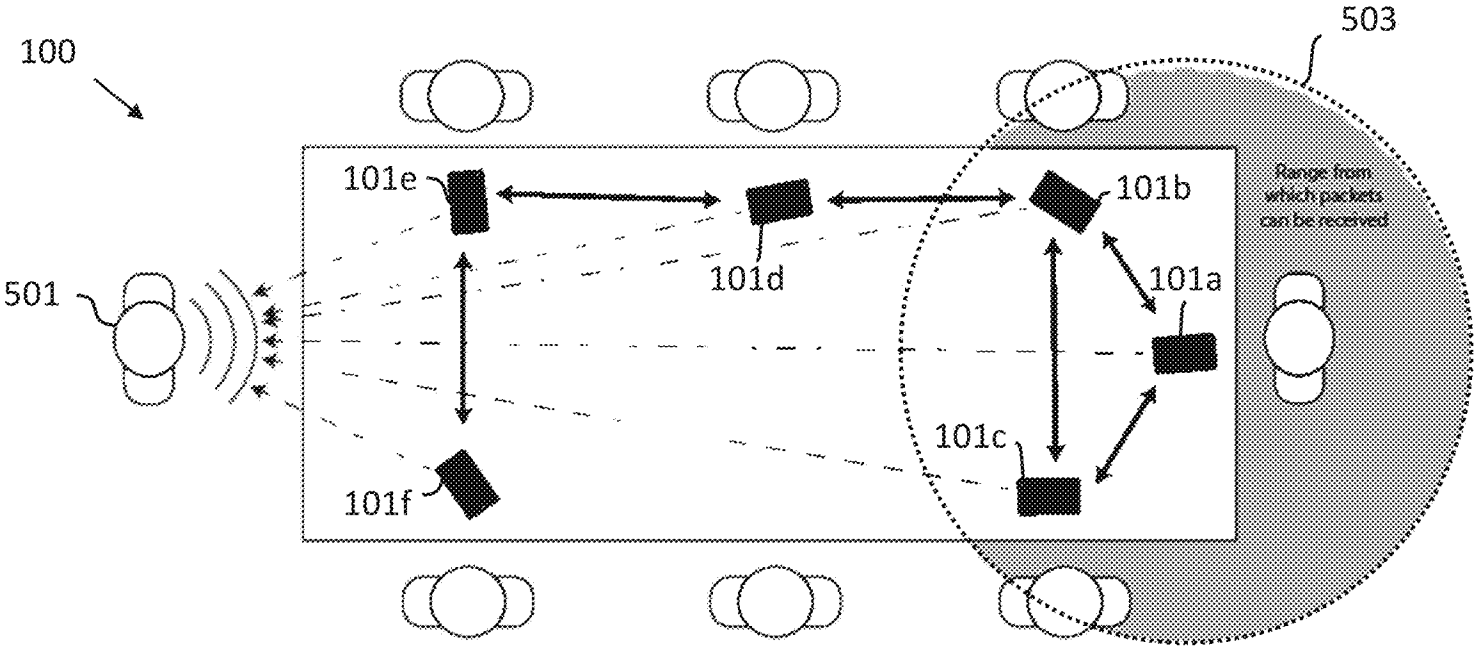
FIG. 5 shows a schematic diagram of an arrangement of sound processing nodes according to an embodiment.

FIG. 5 shows an arrangement 100 of sound processing nodes 101*a-f* according to an embodiment that can be used in the context of a business meeting. The exemplary six sound processing nodes 101*a-f* are defined by six cellphones 101*a-f*, which are being used to record and beamform the voice of the speaker 501 at the left end of the table. Here, the dashed arrows indicate the direction from each cellphone, i.e. sound processing node, 101*a-f* to the target source and the solid double-headed arrows denote the channels of communication between the nodes 101*a-f*. The circle at the right hand side illustrates the transmission range 503 of the sound processing node 101*a* and defines the neighbor connections to the neighboring sound processing nodes 101*b* and 101*c*, which are determined by initially observing what packets can be received given the exemplary transmission range 503. As described above, these communication channels are used by the network of sound processing nodes 101*a-f* to transmit the estimated dual variables $A_i$, in addition to any other node based variables relating to the chosen implementation of solver, between neighbouring nodes. This communication may be achieved via a number of wireless protocols including, but not limited to, LTE, Bluetooth and Wifi based systems, in case a dedicated node to node protocol is not available. From this process, each sound processing node 101*a-f* can store a recording of the beamformed signal which can then be played back by any one of the attendees of the meeting at a later date. This information could also be accessed in "real time" by an attendee via the cellphone closest to him.

In the case of arrangement of sensor nodes in the form of fixed structure wireless sensor networks, embodiments of the invention can provide similar transmission (and hence power consumption), computation (in the form of a smaller matrix inversion problem) and memory requirements as other conventional algorithms, which operate in tree type networks, while providing an optimal beamformer per block rather than converging to one over time. In particular, for slowly varying sound fields, embodiments of the invention allow to automatically track these changes.

In particular, for arrangements with a large numbers of sound processing nodes, which may be used in the case of speech enhancement in large acoustic spaces, the above described embodiments especially suited for acyclic networks provide a significantly better performance than fully connected implementations of conventional algorithms. For this reason embodiments of the present invention are a potential tool for any existing distributed beamformer applications where a block-optimal beamformer is desired.

Moreover, embodiments of the present invention provide, amongst others, the following advantages. Embodiments of the invention remove the need for directly estimating the CPSD matrix used in LCMV type beamforming. This results in a significant reduction in the amount of data which is required to be transmitted within the network per frame. In particular, the slowly varying nature of many practical sound fields, such as those in business meeting or a presentation environment, is exploited to lead to statistically optimal performance whilst still being able to adapt to variations in the sound field over time. Embodiments of the invention offer a wide degree of flexibility in how to implement the DCL algorithm due to the generalized nature of the distributed optimization formulation. Furthermore, this has the advantage of allowing a tradeoff between different performance metrics, while making choices in different implementation aspects, such as the distributed solvers which can be used, the communication algorithms which can be implemented between nodes, or the application of additional restrictions to the network topology to exploit finite convergence methods. Furthermore, as an embodiment of the invention is based on an LCMV beamformer, additional constraint terms can be easily included in order to provide greater control over the response of the spatial filter. For instance, this may include the nulling of known interferers.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the invention beyond those described herein. While the present invention has been described with reference to one or more particular embodiments, those skilled in the art recognize that many changes may be made thereto without departing from the scope of the present invention. It is therefore to be understood that within the scope of the appended claims and their equivalents, the invention may be practiced otherwise than as specifically described herein.

What is claimed is:

1. A sound processing node for an arrangement of sound processing nodes that are configured to receive a plurality of sound signals, wherein the sound processing node comprises:

a processor configured to:

generate an output signal based on the plurality of sound signals weighted by a plurality of beamforming weights, and determine the plurality of beamforming weights based on an adaptive linearly constrained minimum variance beamforming algorithm using a transformed version of a least mean squares formulation of a constrained gradient descent approach, wherein the transformed version of the least mean squares formulation of the constrained gradient descent approach is based on a transformation of the least mean squares formulation of the constrained gradient descent approach to a dual domain, and wherein the processor is configured to determine the plurality of beamforming weights using the transformed version of the least mean squares formulation of the constrained gradient descent approach in the dual domain according to:

$$\min \sum_{i \in V} \left( \frac{1}{2} \lambda_i^H \phi_i^H \phi_i \lambda_i - \Re(\lambda_i^H (\theta_i - \phi_i^H \mathcal{X}_i)) \right)$$

$$\text{s.t. } \lambda_i = \lambda_j \ \forall (i, j) \in E$$

where:

i,j denote sound processing node indices, $\Re(\ldots)$ denotes a real part of the quantity in parentheses, V denotes a set of all sound processing nodes of the arrangement of sound processing nodes, E denotes a set of sound processing nodes defining an edge of the arrangement of sound processing nodes, $\lambda_i$ denotes the dual variable, $\chi_i$, $\phi_i$, and $\theta_i$ are defined by:

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

$$\theta_{i(l)} = \left[ N y_{i,l-1}^H w_{i,l-1}, N y_{i,l}^H w_{i,l-1}, N \|y_{i,l}\|_2^2, 0^T, \left( \Lambda_{i,l}^H w_{i,l-1} - \frac{f_l}{N} \right)^T \right]^T$$

index l denotes a current frame of the plurality of sound signals, index l−1 denotes a previous frame of the plurality of sound signals, $y_{i,l}$ denotes a vector of sound signals received by an i-th sound processing node in the current frame l, $w_{i,l-1}$ denotes an i-th beamforming weight vector of the previous frame l−1, N denotes a total number of sound processing nodes, $\Lambda_{i,l}$ denotes an i-th column of a matrix $\Lambda_l$, and $\Lambda_l$ and $f_l$ are defined by:

$$e_l = \Lambda_l (\Lambda_l^H \Lambda_l)^{-1} (\Lambda_l w_{l-1} - f_l)$$

$$a_l = \|y_l\|_2^2$$

$$b_l = (I - \Lambda_l (\Lambda_l^H \Lambda_l)^{-1} \Lambda_l^H) y_l$$

$$\hat{x}_{l|l-1} = w_{l-1}^H y_l$$

$a_l$ denotes a magnitude of the vector of sound signals received by the i-th sound processing node in the current frame l, $e_l$ denotes an error correction term for ensuring that the plurality of beamforming weights are unbiased, $b_l$ denotes a component of the vector of sound signals received by the i-th sound processing node in the current frame l that is orthogonal to the output signal, and $\hat{x}_{l|l-1}$ denotes an output signal for the current frame l using the plurality of beamforming weights for the previous frame l−1.

2. The sound processing node of claim 1, wherein the processor is configured to determine the plurality of beamforming weights using the transformed version of the least mean squares formulation of the constrained gradient descent approach in the dual domain based on a distributed algorithm including:

$$\lambda_i^{(t+1)} = \underset{\lambda}{\operatorname{argmin}} \frac{1}{2}\lambda^H \phi_i^H \phi_i \lambda - \Re(\lambda^H(\theta_i - \phi_i^H \chi_i)) + \sum_{j \in N(i)} \left( -\frac{i-j}{|i-j|}\gamma_{j|i}^H \lambda + \frac{1}{2}\|\lambda - \lambda_j^{(t)}\|_{R_{p,i|j}}^2 \right)$$

$$\gamma_{i|j}^{(t+1)} = \gamma_{j|i}^{(t)} - \frac{i-j}{|i-j|} R_{p,i|j}(\lambda_i^{(t+1)} - \lambda_j^{(t)})$$

where:

index t denotes a current time step, index t−1 denotes a previous time step,

N(i) denotes a set of sound processing nodes neighboring the i-th sound processing node, $\gamma_{i|j}$ wherein denotes a dual-dual variable defined along a directed edge from the i-th sound processing node to a j-th sound processing node, and $R_{p,i|j}$ denotes a penalization matrix for penalizing an infeasibility of edge based consensus constraints.

3. The sound processing node of claim 2, wherein the processor is configured to use the penalization matrix $R_{p,i|j}$ defined by:

$$R_{p,i|j} = \phi_i^H \phi_i + \phi_j^H \phi_j.$$

4. The sound processing node of claim 2, wherein the distributed algorithm is based on an alternating direction method of multipliers (ADMM).

5. The sound processing node of claim 2, wherein the distributed algorithm is based on a primal dual method of multipliers (PDMM).

6. The sound processing node of claim 1, wherein the processor is configured to determine the plurality of beamforming weights based on a message passing algorithm.

7. The sound processing node of claim 6, wherein the processor is configured to determine the plurality of beamforming weights based on the message passing algorithm according to:

$$M_{i \to \mathcal{P}_i} = \phi_i^H \phi_i + \sum_{k \in C_i} M_{k \to i}$$

$$m_{i \to \mathcal{P}_i} = \phi_i^H \mathcal{X}_i + \theta_i + \sum_{k \in C_i} m_{k \to i}.$$

where:

$P_i$ denotes a parent sound processing node of the i-th sound processing node;

$C_i$ denotes a set of child sound processing nodes of the t-th sound processing node;

$M_{i \to P_i}$ denotes a matrix to be transmitted from the sound processing node to its parent sound processing node $P_i$; and $m_{i \to P_i}$ denotes a vector to be transmitted from i-th sound processing node to its parent sound processing node $P_i$.

8. The sound processing node of claim 1, wherein the least mean squares formulation of the constrained gradient descent approach is defined by:

$$w_l = \left(I - \Lambda_l(\Lambda_l^H \Lambda_l)^{-1}\Lambda_l^H\right)\left(I - \mu \frac{y_l y_l^H}{\|y_l\|_2^2}\right) w_{l-1} + \Lambda_l(\Lambda_l^H \Lambda_l)^{-1} f_l$$

where μ denotes a step size parameter controlling a rate of adaptation of the algorithm.

9. A sound processing system comprising a plurality of sound processing nodes according to claim 1, wherein the plurality of sound processing nodes are configured to exchange variables for determining the plurality of beamforming weights based on an adaptive linearly constrained minimum variance beamforming algorithm using the transformed version of the least mean squares formulation of the constrained gradient descent approach.

10. A method of operating a sound processing node for an arrangement of sound processing nodes configured to receive a plurality of sound signals, the method comprising:

generating an output signal based on the plurality of sound signals weighted by a plurality of beamforming weights by determining the plurality of beamforming weights based on an adaptive linearly constrained minimum variance beamforming algorithm using a transformed version of a least mean squares formulation of a constrained gradient descent approach, wherein the transformed version of the least mean squares formulation of the constrained gradient descent approach is based on a transformation of the least mean squares formulation of the constrained gradient descent approach to a dual domain, and wherein determining the plurality of beamforming weights using the transformed version of the least mean squares formulation of the constrained gradient descent approach in the dual domain is performed according to:

$$\min \sum_{i \in V} \left( \frac{1}{2}\lambda_i^H \phi_i^H \phi_i \lambda_i - \Re(\lambda_i^H(\theta_i - \phi_i^H X_i)) \right)$$

$$\text{s.t. } \lambda_i = \lambda_j \ \forall (i, j) \in E$$

where:

i,j denote sound processing node indices, $\Re(\ .\ .\ .\ )$ denotes a real part of the quantity in parentheses, V denotes a set of all sound processing nodes of the arrangement of sound processing nodes, E denotes a set of sound processing nodes defining an edge of the arrangement of sound processing nodes, $\lambda_i$ denotes a dual variable, $\chi_i$, $\phi_i$, and $\theta_i$ are defined by:

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

-continued $$\theta_{i(l)} = \left[ N y_{i,l-1}^H w_{i,l-1},\ N y_{i,l}^H w_{i,l-1},\ N\|y_{i,l}\|_2^2,\ 0^T,\ \left(\Lambda_{i,l}^H w_{i,l-1} - \frac{f_l}{N}\right)^T \right]^T$$

index l denotes a current frame of the plurality of sound signals, index l−1 denotes a previous frame of the plurality of sound signals, $y_{i,l}$ denotes a vector of sound signals received by an i-th sound processing node in the current frame l, $w_{i,l-1}$ denotes an i-th beamforming weight vector of the previous frame l−1, N denotes a total number of sound processing nodes, $\Lambda_{i,l}$ denotes an i-th column of a matrix $\Lambda_l$, and $\Lambda_l$ and $f_l$ are defined by:

$$e_l = \Lambda_l(\Lambda_l^H \Lambda_l)^{-1}(\Lambda_l w_{l-1} - f_l)$$

$$a_l = \|y_l\|_2^2$$

$$b_l = (I - \Lambda_l(\Lambda_l^H \Lambda_l)^{-1}\Lambda_l^H) y_l$$

$$\hat{x}_{l|l-1} = w_{l-1}^H y_l$$

$a_l$ denotes the magnitude of the vector of sound signals received by the i-th sound processing node in the current frame l, $e_l$ denotes an error correction term for ensuring that the plurality of beamforming weights are unbiased, $b_l$ denotes the component of the vector of sound signals received by the i-th sound processing node in the current frame l that is orthogonal to the output signal, and $\hat{x}_{l|l-1}$ denotes an output signal for the current frame l using the plurality of beamforming weights for the previous frame l−1.

11. The method of claim 10, wherein determining the plurality of beamforming weights using the transformed version of the least mean squares formulation of the constrained gradient descent approach in the dual domain is based on a distributed algorithm including:

$$\lambda_i^{(t+1)} = \underset{\lambda}{\operatorname{argmin}} \frac{1}{2}\lambda^H \phi_i^H \phi_i \lambda - \Re(\lambda^H(\theta_i - \phi_i^H \chi_i)) + \sum_{j \in N(i)} \left( -\frac{i-j}{|i-j|}\gamma_{j|i}^H \lambda + \frac{1}{2}\|\lambda - \lambda_j^{(t)}\|_{R_{p,i|j}}^2 \right)$$

$$\gamma_{i|j}^{(t+1)} = \gamma_{j|i}^{(t)} - \frac{i-j}{|i-j|} R_{p,i|j}(\lambda_i^{(t+1)} - \lambda_j^{(t)})$$

where:

index t denotes a current time step, index t−1 denotes a previous time step,

N(i) denotes a set of sound processing nodes neighboring the i-th sound processing node, $y_{i|j}$ denotes a dual-dual variable defined along a directed edge from the i-th sound processing node to a j-th sound processing node, and $R_{p,i|j}$ denotes a penalization matrix for penalizing an infeasibility of edge based consensus constraints.

12. The method of claim 11, wherein the penalization matrix $R_{p,i|j}$ is defined by:

$$R_{p,i|j} = \phi_i^H \phi_i + \phi_j^H \phi_j.$$

13. The method of claim 11, wherein the distributed algorithm is based on an alternating direction method of multipliers (ADMM).

14. The method of claim 11, wherein the distributed algorithm is based on a primal dual method of multipliers (PDMM).

15. The method of claim 10, wherein determining the plurality of beamforming weights is based on a message passing algorithm.

16. The method of claim 15, wherein determining the plurality of beamforming weights based on the message passing algorithm is based on:

$$M_{i \to P_i} = \phi_i^H \phi_i + \sum_{k \in C_i} M_{k \to i}$$

$$m_{i \to P_i} = \phi_i^H \chi_i + \theta_i + \sum_{k \in C_i} m_{k \to i}.$$

where:

$P_i$ denotes a parent sound processing node of the i-th sound processing node;

$C_i$ denotes a set of child sound processing nodes of the i-th sound processing node;

$M_{i \to P_i}$ denotes a matrix to be transmitted from the i-th sound processing node to its parent sound processing node $P_i$; and $m_{i \to P_i}$ denotes a vector to be transmitted from i-th sound processing node to its parent sound processing node $P_i$.

17. The method of claim 10, wherein the least mean squares formulation of the constrained gradient descent approach is defined by:

$$w_l = \left(I - \Lambda_l(\Lambda_l^H \Lambda_l)^{-1}\Lambda_l^H\right)\left(I - \mu \frac{y_l y_l^H}{\|y_l\|_2^2}\right) w_{l-1} + \Lambda_l(\Lambda_l^H \Lambda_l)^{-1} f_l$$

where μ denotes a step size parameter controlling a rate of adaptation of the algorithm.

18. A non-transitory storage medium comprising program code that, when executed by a computer, facilitates the computer carrying out a method comprising:

generating an output signal based on the plurality of sound signals weighted by a plurality of beamforming weights by determining the plurality of beamforming weights based on an adaptive linearly constrained minimum variance beamforming algorithm using a transformed version of a least mean squares formulation of a constrained gradient descent approach, wherein the transformed version of the least mean squares formulation of the constrained gradient descent approach is based on a transformation of the least mean squares formulation of the constrained gradient descent approach to a dual domain, and wherein determining the plurality of beamforming weights using the transformed version of the least mean squares formulation of the constrained gradient descent approach in the dual domain is performed according to:

$$\min \sum_{i \in V} \left( \frac{1}{2} \lambda_i^H \phi_i^H \phi_i \lambda_i - \Re(\lambda_i^H (\theta_i - \phi_i^H \chi_i)) \right)$$

$$\text{s.t. } \lambda_i = \lambda_j \ \forall (i, j) \in E$$

where:

i,j denote sound processing node indices, $\Re(\ldots)$ denotes a real part of the quantity in parentheses, V denotes a set of all sound processing nodes of the arrangement of sound processing nodes, E denotes a set of sound processing nodes defining an edge of the arrangement of sound processing nodes, $\lambda_i$ denotes a dual variable, $\chi_i$, $\phi_i$, and $\theta_i$ are defined by:

$$\chi_i = [0, 0, 0, y_{i,l}^T, 0]^T$$

$$\phi_i = \begin{pmatrix} 1 & 0 & 0 & 0 & 0 \\ 0 & 1 & 0 & 0 & 0 \\ 0 & 0 & 1 & 0 & 0 \\ 0 & 0 & 0 & \Lambda_{i,l} & 0 \\ 0 & 0 & 0 & 0 & \Lambda_{i,l} \end{pmatrix}$$

$$\theta_{i(l)} = \left[ N y_{i,l-1}^H w_{i,l-1}, N y_{i,l}^H w_{i,l-1}, N \|y_{i,l}\|_2^2, 0^T, \left( \Lambda_{i,l}^H w_{i,l-1} - \frac{f_l}{N} \right)^T \right]^T$$

index l denotes a current frame of the plurality of sound signals, index l−1 denotes a previous frame of the plurality of sound signals, $y_{i,l}$ denotes a vector of sound signals received by an i-th sound processing node in the current frame l, $w_{i,l-1}$ denotes an i-th beamforming weight vector of the previous frame l−1, N denotes a total number of sound processing nodes, $\Lambda_{i,l}$ denotes an i-th column of a matrix $\Lambda_l$, and $A_l$ and $f_l$ are defined by:

$$e_l = \Lambda_l (\Lambda_l^H \Lambda_l)^{-1} (\Lambda_l w_{l-1} - f_l)$$

$$a_l = \|y_l\|_2^2$$

$$b_l = (I - \Lambda_l (\Lambda_l^H \Lambda_l)^{-1} \Lambda_l^H) y_l$$

$$\hat{x}_{l|l-1} = w_{l-1}^H y_l$$

$a_l$ denotes the magnitude of the vector of sound signals received by the i-th sound processing node in the current frame l, wherein $e_i$ denotes an error correction term for ensuring that the plurality of beamforming weights are unbiased, wherein $b_l$ denotes the component of the vector of sound signals received by the i-th sound processing node in the current frame l that is orthogonal to the output signal, and wherein $\hat{x}_{l|l-1}$ denotes an output signal for the current frame l using the plurality of beamforming weights for the previous frame l−1.

* * * * *